US007049503B2

(12) United States Patent
Onozawa et al.

(10) Patent No.: US 7,049,503 B2
(45) Date of Patent: May 23, 2006

(54) HYBRID WIND INSTRUMENT SELECTIVELY PRODUCING ACOUSTIC TONES AND ELECTRIC TONES AND ELECTRONIC SYSTEM USED THEREIN

(75) Inventors: Naoyuki Onozawa, Shizuoka-ken (JP); Kazuhiro Fujita, Shizuoka-ken (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/066,922

(22) Filed: Feb. 28, 2005

(65) Prior Publication Data

US 2005/0217464 A1 Oct. 6, 2005

(30) Foreign Application Priority Data

Mar. 31, 2004 (JP) ..... 2004-102302

(51) Int. Cl.
*G10H 3/00* (2006.01)

(52) U.S. Cl. ..... 84/723

(58) Field of Classification Search ..... 84/723
See application file for complete search history.

(56) References Cited

U.S. PATENT DOCUMENTS 4,342,244 A * 8/1982 Perkins ..... 84/672
4,527,456 A * 7/1985 Perkins et al. ..... 84/654
4,915,008 A * 4/1990 Sakashita ..... 84/658
5,149,904 A * 9/1992 Kamiya et al. ..... 84/723
5,459,280 A * 10/1995 Masuda et al. ..... 84/622
5,543,580 A * 8/1996 Masuda ..... 84/723
5,736,662 A * 4/1998 Spector ..... 84/600
6,881,890 B1 * 4/2005 Sakurada ..... 84/654

FOREIGN PATENT DOCUMENTS

JP 11-85159 3/1999

* cited by examiner

*Primary Examiner*—Jeffrey W Donels
(74) *Attorney, Agent, or Firm*—Dickstein, Shapiro, Morin & Oshinsky, LLP

(57) ABSTRACT

A hybrid saxophone is a combination of an acoustic saxophone and an electronic system, and the electronic system includes key sensors for monitoring the keys and a tonguing sensor for detecting the position of the tongue together with a breath sensor and a lip sensor, and the pieces of playing data are brought to an electronic tone generator for producing electric tones; the mouthpiece of the acoustic saxophone is replaced with another mouthpiece, which does not supply the breath to the reed, and a rotary type air-flow regulator is provided in the mouthpiece so that the player feels the blowing same as that in the acoustic saxophone.

20 Claims, 3 Drawing Sheets

HYBRID WIND INSTRUMENT SELECTIVELY PRODUCING ACOUSTIC TONES AND ELECTRIC TONES AND ELECTRONIC SYSTEM USED THEREIN

FIELD OF THE INVENTION

This invention relates to a wind instrument and, more particularly, to a hybrid wind instrument for selectively producing electronic tones and acoustic tones.

DESCRIPTION OF THE RELATED ART

A wind instrument is defined in a dictionary of music as "musical instruments in which the sound is produced through the vibrations of a column of air which is set in motion by the player's breath". In the following description, term "acoustic tones" means tones which are produced through the vibrations of the column of air. On the other hand, term "electric tones" means tones which are covered from an electric signal.

While the player is breathing into the wind instrument, the loud tones are radiated from the wind instrument, and the neighborhood feels such loud tones irritating. Although various types of mutes have been proposed for the wind instruments, the mutes merely reduce the loudness so that the neighborhood still feels the tones noisy.

An electronic wind instrument is effective against the nuisance. The electronic wind instrument is equipped with a lip sensor, a breath sensor and key sensors, and a data processor analyzes pieces of performance data representative of the actions of the lip and tongue, the pressure of breath and fingering on the keys for producing music data codes. The music data codes are supplied to an electronic tone generator, and an audio signal is produced on the basis of the music data codes through the electronic tone generator. The audio signal is supplied to a sound system so as to be converted to the electric tones. The loudness is easily controlled through the sound system.

A typical example of the electronic wind instrument is disclosed in Japan Patent Application laid-open No. Hei 11-85159. The prior art electronic wind instrument includes a long tube-like body, a mouthpiece, a key mechanism, control switches and an electronic tone generating system. The mouthpiece is attached to one end of the long bar-like body, and the key mechanism and control switches are provided on the obverse surface and reverse surface of the long tube-like body.

The mouthpiece is equipped with the lip sensor and breath sensor, and is connected through a drainpipe to an exhaust hole, which is formed in the lower portion of the long tube-like body. The lip sensor supplies a detecting signal, which represents how the player keeps the mouthpiece between his or her lips, to the data processor, and the breath sensor reports the pressure of the air to the data processor. The player specifies the pitch of tones to be produced through the key mechanism. The key action is detected with key sensors, and detecting signals are also supplied from the key sensors to the data processor. The data processor analyzes these pieces of music data, and produces MIDI (Musical Instrument Digital Interface) music data codes through the analysis. The MIDI music data codes are output from the MIDI-out terminal to a sound system or another electronic musical instrument.

The fingering on the key mechanism is analogous to that on a saxophone or a recorder. However, there are several differences between the acoustic wind instruments and the prior art electronic wind instrument. For example, the lip sensor and breath sensor can merely discriminate some labial actions from each other. In other words, the pieces of performance data, which are brought to the data processor through the detecting signals, are not enough to produce the electric tones in various artificial expressions. For this reason, when the player wishes to impart the pitch bend effect to the tones, he or she rotates a bend wheel, which is provided on the reverse surface of the long tube-like body. The player pushes a key hold switch, which is also provided on the reverse surface, for prolonging the electric tones. Due to these differences, even if a player has been experienced in the acoustic wind instrument, it is difficult to play a piece of music on the prior art electronic wind instrument. This is the problem inherent in the prior art electronic wind instrument.

SUMMARY OF THE INVENTION

It is therefore an important object of the present invention to provide a hybrid wind instrument, which is available for a performance through both electric and acoustic tones.

To accomplish the object, the present invention proposes to add an electronic system to an acoustic wind instrument.

In accordance with one aspect of the present invention, there is provided a wind instrument for selectively producing acoustic tones and electric tones comprising an acoustic wind instrument including a tubular body defining a column of air inside thereof, a mouthpiece connected to one end of the tubular body and giving rise to vibrations of the column of air for producing the acoustic tones when a player blows thereinto and a pitch changing mechanism provided for the tubular body and manipulated with fingers of the player so as to change the length of the column of air, and an electronic system including a quasi mouthpiece connectable to the aforesaid one end of the tubular body instead of the mouthpiece and permitting the player to blow thereinto without provocation of the vibrations and plural sorts of sensors for producing detecting signals representative of actions of organs of the player and supplying the detecting signals to a signal processing unit so as to permit the signal processing unit to produce an audio signal for producing the electric tones.

In accordance with another aspect of the present invention, there is provided an electronic system combinable with an acoustic wind instrument having a tubular body, a mouthpiece and a pitch changing mechanism comprising a quasi mouthpiece connectable to one end of the tubular body instead of the mouthpiece and permitting a player to blow thereinto without provocation of vibrations of a column of air in the tubular body, and plural sorts of sensors for producing detecting signals representative of actions of organs of the player and supplying the detecting signals to a signal processing unit so as to permit the signal processing unit to produce an audio signal for producing the electric tones.

BRIEF DESCRIPTION OF THE DRAWINGS

The features and advantages of the hybrid wind instrument will be more clearly understood from the following description taken in conjunction with the accompanying drawings, in which.

DESCRIPTION OF THE PREFERRED EMBODIMENT

In the following description, term "upper" is indicative of a relative position closer to the lips of a player, who is performing a piece of music on a hybrid wind instrument, than a position modified with term "lower".

Hybrid Wind Instrument

Figure 1:
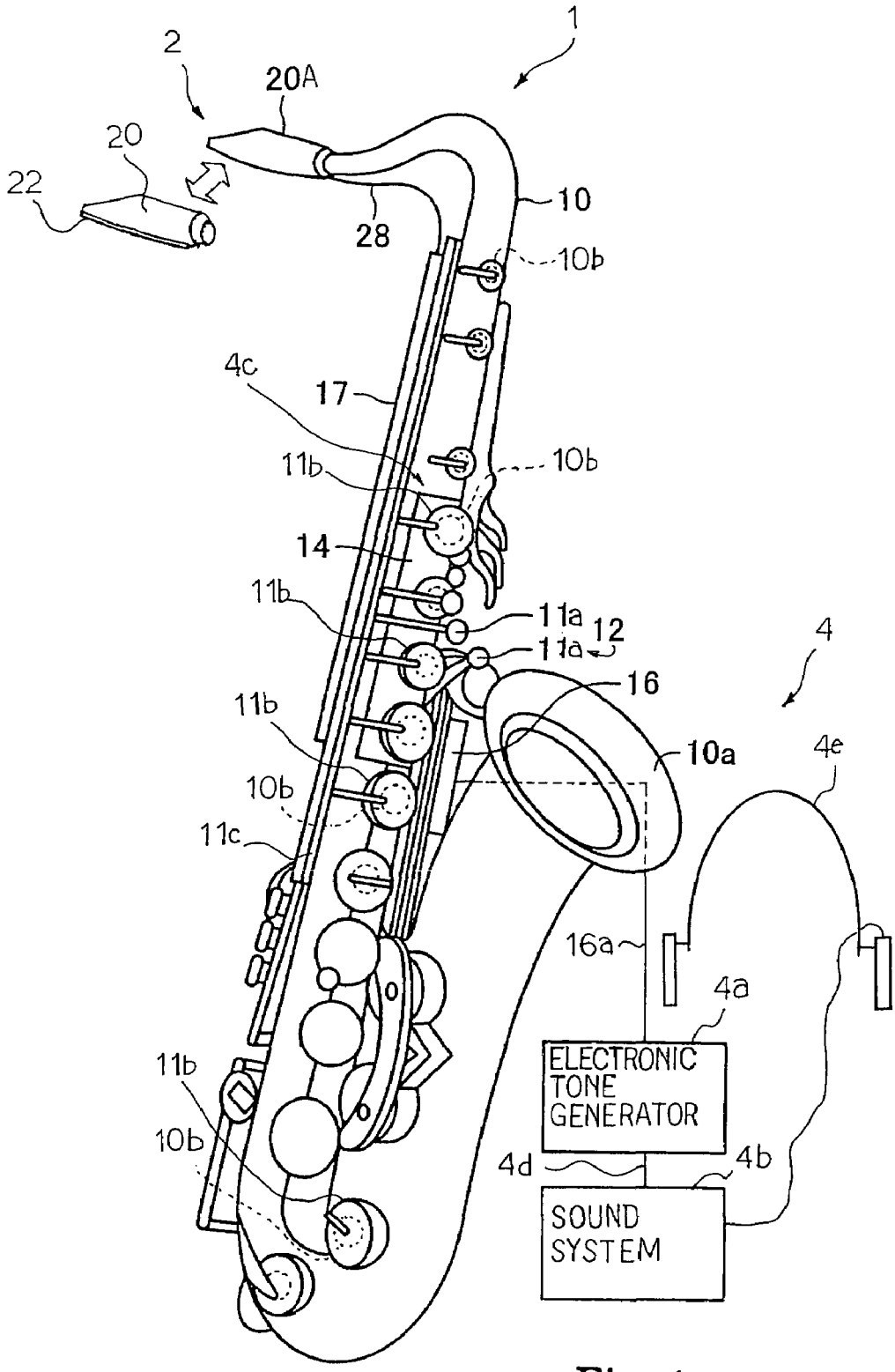
FIG. 1 is a perspective view showing an appearance of a hybrid saxophone according to the present invention.

Referring to FIG. 1 of the drawings, a hybrid saxophone embodying the present invention is designated by reference numeral 1. The hybrid saxophone 1 largely comprises an acoustic saxophone 2 and an electronic system 4. The term "acoustic saxophone" means a standard saxophone, which produces tones through vibrating air column created inside thereof. Acoustic tones are produced through the acoustic saxophone 2, and electric tones are produced in cooperation between the saxophone 2 and the electronic system 4. Thus, the acoustic tones and electric tones are selectively produced through the hybrid saxophone 1.

When a player wishes to do the exercise without disturbing the neighborhood, he or she makes the electronic system 4 enabled to produce the electric tones, and, thereafter, starts to blow and finger a piece of music on the acoustic saxophone 2. The electronic system analyzes detecting signals representative of the blowing and fingering on the acoustic saxophone 2 for producing pieces of music data, and produces the electric tones on the basis of the pieces of music data. Since the electronic system 4 offers a volume control to the player, the player can instruct the electronic system 4 faintly to produce the electric tones, and the player hears the faint electric tones without any disturbance to the neighborhood. Since the piece of music is fingered on the acoustic saxophone, players, who are experienced in acoustic saxophone, can perform pieces of music as usual.

On the other hand, when he wishes to play the acoustic saxophone 2, he or she disables the electronic system 4, and starts to blow and finger a piece of music on the acoustic saxophone 2. The blowing gives rise to vibrations of the column of air, and the player varies the length of the vibrating air column so as to change the pitch of the tones.

As will be appreciated, the players selectively produce the acoustic tones and electric tones through the hybrid saxophone according to the present invention. Nevertheless, the players finger pieces of music on the acoustic saxophone for performing the pieces of music through both acoustic and electric tones. This means that the players who are experienced in acoustic saxophone can immediately play the pieces of music on the hybrid saxophone. Moreover, the players can minimize the loudness of the electric tones through the volume control offered by the electronic system 4. In other words, the players can keep the environment silent during the exercises. Thus, the hybrid saxophone 1 is free from the trade-of between the acoustic saxophone and the prior art electronic wind instrument.

Acoustic Wind Instrument

The acoustic saxophone 2 includes a tubular body 10, a mouthpiece 20 and a key mechanism 12. The tubular body 10 has a generally J-letter shape, and is open to the air at both ends thereof. The inner space, which is defined inside the tubular body, is gradually increased in cross section from the upper end toward the lower end or a bell 10*a*, and plural tone holes, some of which are labeled with "10*b*". The tone holes 10*b* define the length of vibrating air column inside the tubular body 10 in cooperation with the key mechanism 12.

The mouthpiece 20 is connected to the upper end of the tubular body 10, and the key mechanism 12 is provided on the outer surface of the tubular body 10. The upper end of the mouthpiece 20 is thinned like a bill of a water bird, and the player puts the mouthpiece in the mouth for blowing. An air passage is formed in the mouthpiece 20, and is open to the outside on the reverse surface of the mouthpiece 20 and the end surface. A reed 22 is attached to the reverse surface of the mouthpiece 20 in such a manner as to close the air passage on the reverse surface. While the player is blowing, the breath gives rise to vibrations of the air column, and the vibrations are propagated to the inner space defined in the tubular body 10.

The key mechanism 12 includes keys 11*a*, cups 11*b* and link works 11*c*. The cups 11*b* are respectively associated with the tone holes 10*b*, and are connected to the link works 11*c*. The link works 11*c* are further connected to the keys 11*a*, and the keys 11*a* are selectively depressed with the thumbs and fingers of the player. The link works 11*c* propagate the force exerted on the keys 11*a* to the cups 11*b*, and make the tone holes 10*b* selectively open and close. Thus, the player varies the length of the vibrating air column by manipulating the keys 11*a*. The fingering on the keys 11*a* is similar to that on the keys of a standard saxophone.

As will be understood from the foregoing description, the acoustic saxophone 1 is similar in appearance and structure to a standard saxophone, and the player produces the acoustic tones by blowing into mouthpiece 20 and fingering on the key mechanism 12.

Electronic System

The electronic system 4 includes a mouthpiece 20A with built-in sensors, a controller 16, an electronic tone generator 4*a*, a sound system 4*b* and a sensor system 4*c*. The mouthpiece 20 is replaceable with the mouthpiece 20A with built-in sensors. The built-in sensors form parts of the sensor system 4*c*. The sensor system 4*c* and controller 16 are attached to the acoustic saxophone 2, and the sensor system 4*c* is electrically connected to the controller 16 so as to supply detecting signals to the controller 16. The controller 16 is further connected to the electronic tone generator 4*a*, and pieces of playing data, which are carried on the detecting signals, are processed through the electronic tone generator 4*a* so as to produce an audio signal. The electronic tone generating system 4*a* is connected to the sound system 4*b*, and the audio signal is equalized, amplified and converted to the electric tones.

While a player is performing a piece of music on the saxophone 2, the sensor system 4*c* monitors the lips, tongue, breathing and keys 11, and produces an analog detecting signal representative of the pressure exerted by the lips, an analog detecting signal representative of the tonguing, an analog detecting signal representative of the pressure of the out breath and analog detecting signals representative of the positions of the cups 11*b* with respect to the tone holes 10*b*.

These analog detecting signals are supplied to the controller 16. The analog detecting signals are sampled, and are converted to 8-bit digital detecting signals, respectively. The digital detecting signals are supplied to the electronic tone generator 4*a* so that the pieces of playing data are conveyed to the electronic tone generator 4*a* through the digital detecting signals. The electronic tone generator 4*a* analyzes the pieces of playing data so as to determine the electric tones to be produced. The electronic tone generator 4*a* produces music data codes representative of the electric tones, and in turn generates the audio signal on the basis of the music data codes. The audio signal is supplied to the sound system 4*b*. The sound system 4*b* includes an equalizer, an amplifier and a headphone 4*e*, and the audio signal is equalized, amplified and converted to the electric tones. The sound system 4*b* may further include loud speakers (not shown). In this instance, the player can perform a piece of music through loud electric tones.

Figure 2:
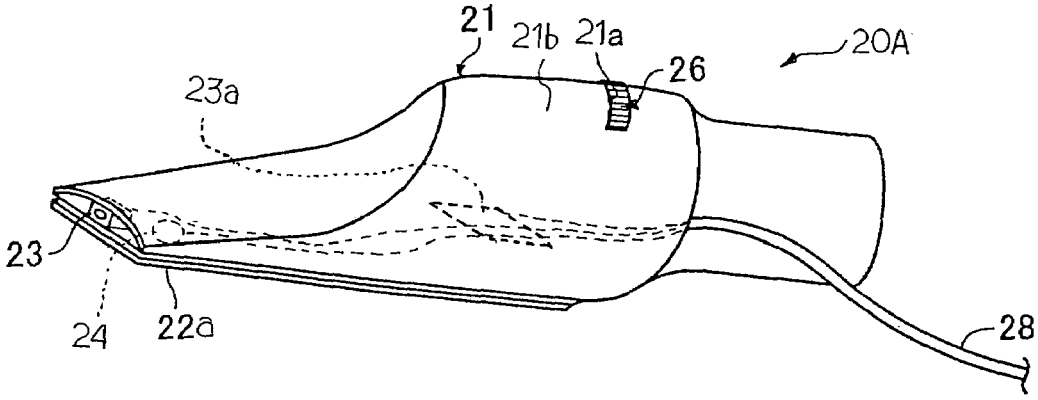
FIG. 2 is a perspective view showing an appearance of a mouthpiece forming a part of an electronic system incorporated in the hybrid saxophone.

As will be better seen in FIG. 2, the mouthpiece 20A includes a body 21 and a reed 22*a*. The body 21 is thinned like the bill of a water bird, and the reed 22*a* is attached to the reverse surface of the body 21. The mouthpiece 20A is similar in appearance to the mouthpiece 20. It is desirable to use the reed 22 as the reed 22*a*, because the reed 22*a* makes the player feel the mouthpiece 20A same as the mouthpiece 20. However, the air passage, which extends from the reverse surface to the end surface in the mouthpiece 20, is not formed in the mouthpiece 20A. For this reason, the reed 22*a* does not vibrate, and, accordingly, the acoustic tones are not produced.

A tonguing sensor 23, a breath sensor 23*a* and a lip sensor 24, which form parts of the sensor system 4*c*, are provided in the mouthpiece 20A, and are connected through a cable 28 to the controller 16. The breath sensor 23*a* may be referred to as a "wind sensor". In this instance, the tonguing sensor 23 is implemented by a reflection-type photo coupler or photo reflector, and pressure-sensitive elements are used as the breath sensor 23*a* and lip sensor 24.

The tonguing sensor 23 is attached to the bill-like portion, and is exposed to the oral cavity of the player during the performance. Infrared light is radiated from the tonguing sensor 23, and is reflected on the tongue of the player. The reflection is incident on the tonguing sensor 23, and the incident infrared light is converted to photo current. While the player is keeping the tongue spaced from the tonguing sensor 23, a small amount of photo current is produced in the tonguing sensor 23. However, when the player moves the tongue in the vicinity of the tonguing sensor 23, the amount of photo current is increased. Thus, the tonguing sensor 23 increases and decreases the photo current depending upon the distance from the tongue.

The breath sensor 23*a* is provided on a wind way. When the player breathes into the mouthpiece 20A, the pressure is exerted on the breath sensor 23*a*, and breath sensor 23*a* varies the amount of current passing therethrough depending upon the pressure.

Figure 3:
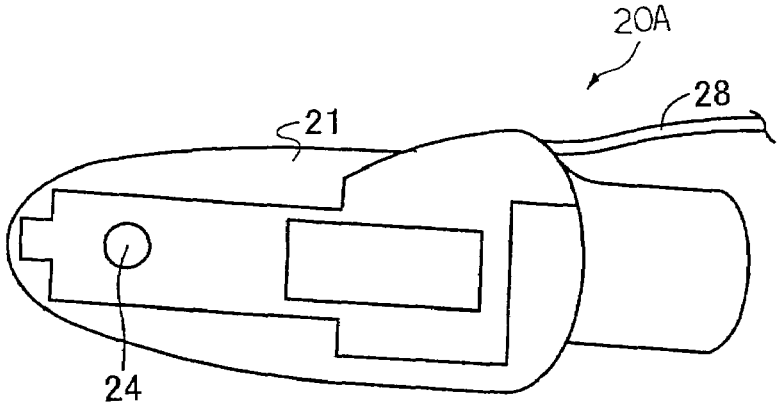
FIG. 3 is a back view showing a lip sensor attached to a bill-like portion of the mouthpiece.

The lip sensor 24 is attached to the reverse surface of the body 21, and is sandwiched between the reed 22*a* and the body 21. If the reed 22*a* is removed from the body 21, the lip sensor 24 is exposed as shown in FIG. 3. While the player is playing a piece of music on the hybrid saxophone 1, he or she keeps the bill-like portion in the mouth, and sandwiches it between the lips. Since the player presses the reed 22*a* to the bill-like portion, the pressure is exerted on the lip sensor 24 so that the lip sensor 24 reports the actions of the lips through the controller 16 to the electronic tone generator 4*a*.

The cable 28 extends from the tonguing sensor 23, breath sensor 23*a* and lip sensor 24, and is taken out from the mouthpiece 20A as shown in FIG. 1. Though not shown in the drawings, a suitable connector is provided at the leading end of the cable 28, and another cable (not shown) extends from the controller 16 to an upper end portion of the tubular body 10. The other cable (not shown) is covered with a cable holder 17, which is secured to the tubular body 10, and is terminated at a corresponding connector. The cable 28 is connected to the other cable through the connectors so that the detecting signals are propagated from the tonguing sensor 23, breath sensor 23*a* and lip sensor 24 through the cables 28 to the controller 16. While the mouthpiece 20A is being attached to the tubular body 10, the cable 28 is jointed to the other cable through the connectors. However, when the player replaces the mouthpiece 20A with the mouthpiece 20, the connectors are released from each other, and the cable 28 is disconnected from the other cable, i.e., the controller 16.

Figure 4:
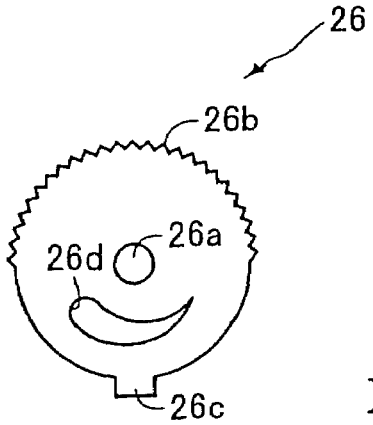
FIG. 4 is a front view showing an air-flow regulator provided in a wind way in the mouthpiece.

Turning back to FIG. 2, the mouthpiece 20A is equipped with a rotary air-flow regulator 26. The body 21 is formed with a slit 21*a*, and the rotary air-flow regulator 26 is partially exposed through the slit 21*a* to the outside. The rotary air-flow regulator 26 has a disk shape as shown in FIG. 4, and is formed with an orifice 26*d*. The orifice 26*d* has a horn-like shape. The orifice 26*d* extends along a lower part of the periphery over a distance less than the width of the wind way, and the width, which is measured in the radial direction of the rotary air-flow regulator 26, is gradually increased in the clockwise direction. A pair of lug portions 26*a* projects from the center of the air-flow regulator 26, and a part of the peripheral surface is milled as indicated by reference 26*b*. When the player rotates the rotary air-flow regulator 26, the corrugated peripheral surface 26*b* prevents the finger from slippage. A stopper 26*c* radially projects on the opposite side to the corrugated peripheral surface 26*b*.

Figure 5:
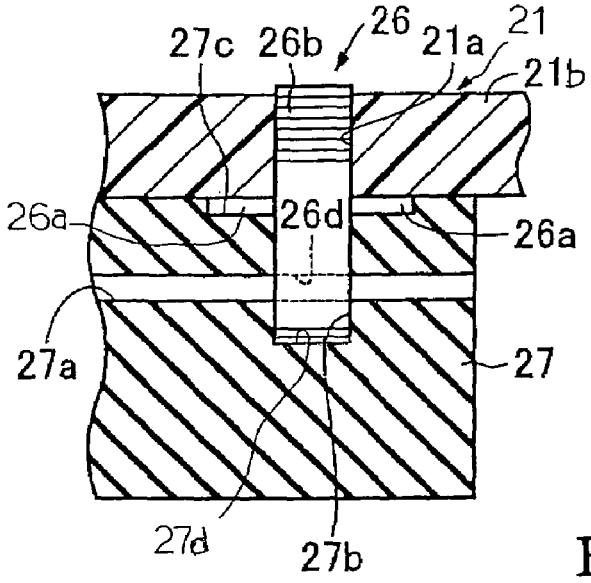
FIG. 5 is a cross sectional view showing the rotary air-flow regulator installed in the mouthpiece.

The body 21 is broken down into a cover plate 21*b* and a bulk 27 as shown in FIG. 5. The bulk 27 is assembled with the cover plate 21*b*, and is hardly seen. The wind way 27*a* is formed in the bulk 27, and extends in the longitudinal direction of the bulk 27. A sectorial recess 27*b* is further formed in the bulk 27, and the wind way 27*a* crosses the sectorial recess 27*b*. The sectorial recess 27*b* is aligned with the slit 21*a*, and a deep sectorial groove 27*d* deepens the bottom of the sectorial recess 27*b*. A pair of grooves 27*c* is further formed in the bulk 27, and the grooves 27*c* extend from the sectorial recess 27*b* in the opposite directions. Since the grooves 27*c* have the width approximately equal to the diameter of the lugs 26*a*, the lugs 26*a* are rotatably received in the grooves 27*c*, respectively, and the grooves 27*c* permit the lugs 26*a* and, accordingly, rotary air-flow regulator 26 to rotate in the mouthpiece 20A. The distance from the grooves 27*c* to the outer surface of the cover plate 21*b* is slightly shorter than the radius of curvature of the rotary air-flow regulator 26 so that the corrugated peripheral surface 26*b* projects through the slit 21*a* over the outer surface of the cover plate 21*b*. On the other hand, the stopper 26*c* is inserted in the deep sectorial groove 27*d* so that the rotation of the rotary air-flow regulator 26 is restricted by the stopper 26*c*. Thus, the rotary air-flow regulator 26 can rotate over a predetermined angle defined by both end surfaces for the deep sectorial groove 27*d*.

The wind way 27*a* is overlapped with the orifice 26*d*. As described hereinbefore, the horn-shaped orifice 26*d* extends over the distance much less than the width of the orifice 26*d*, and the width of the orifice 26*d* is varied along the periphery. For this reason, while the player is rotating the rotary air-flow regulator 26, the orifice 26*d* varies the cross section of the wind way 27*a* and, accordingly resistance against the breath depending upon the angular position thereof. Thus, the player can control the back-pressure in the mouthpiece 20A by manipulating the rotary air-flow regulator 26. When the player wishes to play a piece of music through the electric tones, he or she adjusts the resistance against the breath in the mouthpiece 20A to a value almost equal to the value in the mouthpiece 20. For this reason, the player feels the mouthpiece 20A as usual.

Figure 6:
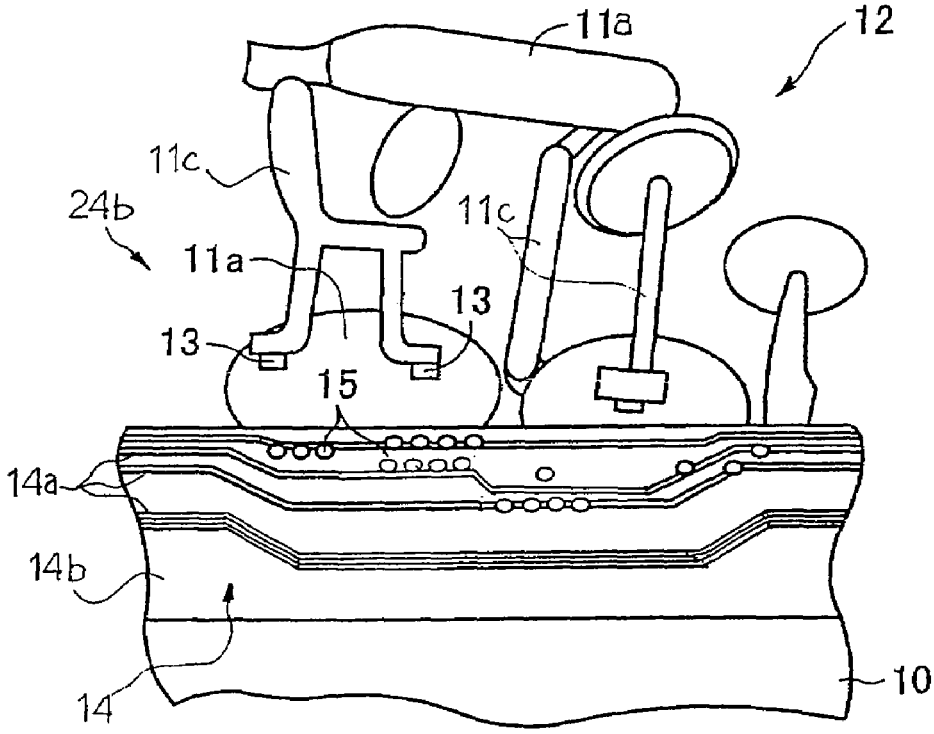
FIG. 6 is a perspective view showing key sensors on a flexible circuit board.

The sensor system 4*c* further includes key sensors 24*b* for monitoring the actions of the keys 11*a*. The key sensors 24*b* are implemented by combinations of pieces of magnet 13 and Hall-effect elements 15 as shown in FIG. 6. A flexible circuit board 14 is secured to the tubular body 10 below the key mechanism 12 (see FIG. 1), and the pieces of magnet 13 are attached to the link works 11*c* and keys 11*a*. On the other hand, conductive lines 14*a* are printed on a flexible board 14*b*, and the Hall-effect elements 15 are provided on the conductive lines 14*a*. The pieces of magnet 13 are respectively opposed to the Hall-effect elements 15, and are selectively moved to the Hall-effect elements 15 in such a manner that the pieces of magnet 13, which are in the proximity of the Hall-effect elements 15, are laid on one of the different patterns depending upon the tone to be produced. When the piece of magnet 13 is moved to the associated Hall-effect element 15, the associated Hall-effect element 15 makes the potential level on the conductive line varied, and the controller 16 determines the tone to be produced.

The electronic tone generator 4*a* includes a microprocessor, a program memory, a working memory, a signal interface, a tone generator and a bus system. A computer program is stored in the program memory, and the programmed instructions are sequentially executed by the microprocessor. Parameter tables are further stored in the program memory, and the program memory may be given in the form of a memory card. The microprocessor, program memory, working memory, signal interface and tone generator are connected to the bus system, and pieces of data are transferred between these system components through the bus system. A cable 16*a* is connected from the controller 16 to the signal interface so that the digital detecting signals are transferred from the controller 16 through the cable 16*a* to the signal interface. Another cable 4*d* is further connected between the signal interface and the sound system 4*b*, and the audio signal is propagated from the signal interface to the sound system 4*b*.

The microprocessor periodically fetches the pieces of playing data, which are carried on the digital detecting signals, and stores the pieces of playing data in the working memory. The microprocessor analyzes the pieces of playing data in the working memory to see whether or not the player changes the position of the tongue, strength of breath, pressure on the bill-like portion and/or the depressed/released keys 11*a*. When the answer is given affirmative, the microprocessor determines the pitch, loudness and length of the electric tone to be produced, and produces the music data code representative of these pieces of music data representative of the attributes of the electric tone. The microprocessor determines the length of tone and loudness on the basis of the pieces of playing data supplied from the tonguing sensor 23 and the pieces of playing data supplied from the breach sensor 23*a*, respectively. Since the rip sensor 24 supplements the piece of playing data, the microprocessor can determine the pitch bend without the pitch vend wheel. The microprocessor transfers the music data through the bus system to the tone generator. Pieces of waveform data are stored in a waveform memory incorporated in the tone generator, and a data reader, which is also incorporated in the tone generator, successively reads out the pieces of waveform data. An envelope is given to the series of pieces of waveform data, and the series of pieces of waveform data is converted to the audio signal. The audio signal is supplied through the signal interface to the sound system 4*b*.

Assuming now that a player wishes to perform a piece of music through the electric tones, he or she replaces the mouthpiece 20 with the mouthpiece 20A, and connects the cable 28 to the other cable (not shown) covered with the cable holder 17. The player further connects the cable 16*a* to the electronic tone generator 4*a*. The player rotates the rotary air-flow regulator 26, and adjusts the resistance against the breath to a value approximately equal to that of a standard saxophone, with which he or she is familiar. Then, the player starts to perform a piece of music.

While the player is blowing into the mouthpiece 20A and tonguing on the end surface of the mouthpiece 20A, the breath sensor 23*a*, lip sensor 24 and tonguing sensor 23 vary the potential level of the analog detecting signals, and the controller 16 transfers the pieces of playing data through the digital detecting signal to the electronic tone generator 4*a*. The player selectively depresses and releases the keys 11*a* during the performance, and the key sensors 24*b* inform the key actions through the controller 16 to the electronic tone generator 4*a*. The player feels the blowing as similar to that into the standard saxophone, and the fingering on the keys 11*a* are same as that on the standard saxophone.

The player is assumed to wish to impart the pitch bend effect to the electric tone. He or she blows and manipulates the keys 11*a* as similar to those on the standard saxophone. Since the lip sensor 24 gives an additional piece of playing data to the electronic tone generator 4*a*, the microprocessor requests the tone generator to give the pitch bend to the electric tone.

When the player does not wish to disturb the neighborhood, he or she electrically disconnects the loud speakers from the sound system 4*b*, and monitors the electric tones through the headphone 4*e*.

As will be appreciated from the foregoing description, the player can play a piece of music on the hybrid saxophone selectively through the acoustic tones and corresponding electric tones. The blowing and fingering are not different from those on the standard saxophone so that the players easily play the hybrid saxophone.

The lip sensor 24 gives the piece of playing data representative of the force exerted on the mouthpiece 20 so that the electronic tone generator 4*a* can impart various effects to the electric tones.

Moreover, the player easily minimizes the loudness of the electric tones through the sound system 4*b* so that he or she can do exercise without disturbance to the neighborhood.

Although particular embodiments of the present invention have been shown and described, it will be apparent to those skilled in the art that various changes and modifications may be made without departing from the spirit and scope of the present invention.

For example, the acoustic saxophone does not set any limit to the technical scope of the present invention. The electronic system 4 may be installed in another sort of wind instrument such as, for example, a wood wind instrument such as clarinets or brass instruments such as trumpets.

In the hybrid saxophone, the tone holes 10*b*, which are selectively open and closed with the key mechanism 12, define the length of the vibrating air column. However, the tone holes do not set any limit of the technical scope of the present invention. For example, an additional tube is prepared in the trumpet and trombone. The player changes the length of the tubular body by using the additional tube for changing the pitch of the acoustic tones.

The rotary air-flow regulator 26 does not set any limit to the technical scope of the present invention. A push-button type air-flow regulator may be incorporated in the mouthpiece 20A. The air-flow regulator may be attached to the tubular body 10.

Moreover, the orifice 26*d* does not set any limit to the technical scope of the present invention. Any device, which can vary the resistance against the breath, is available for the hybrid wind instrument. The orifice 26*d* may be replaced with a valve or a venturi tube.

The electronic tone generator 4*a* may be mounted on the hybrid wind instrument together with the controller 16. Moreover, a simple sound system may be further mounted on the hybrid wind instrument. On the other hand, the controller 16 may form a part of the electronic tone generator. In this instance, the detecting signals are directly supplied to the electronic tone generator.

The electronic tone generator of another musical instrument is available for the hybrid wind instrument according to the present invention. In other words, the controller 16, electronic tone generator 4*a* and sound system 4*b* are not indispensable system components of the electronic system 4.

The electronic system 4 may be sold separately from the acoustic saxophone 2. A user retrofits the acoustic saxophone 2 to the hybrid wind instrument 1 by combining the electronic system 4 with the acoustic saxophone 2.

Another sort of tonguing sensor 23 may produce a detecting signal representative of the velocity of the tongue actions. The tonguing sensor 23 may be replaced with an image pick-up sensor. In this instance, the tonguing may be determined through a computer program for an image recognition.

The Hall-effect sensors do not set any limit to the technical scope of the present invention. The Hall-effect sensors may be replaced with pressure sensors or optical sensors.

The component parts of the hybrid saxophone 1 are correlated with claim languages as follows. The saxophone 2 serve as an "acoustic wind instrument", and the tone holes 10*b* and key mechanism 12 as a whole constitute a "pitch changing mechanism". The mouthpiece 20A is corresponding to a "quasi mouthpiece", and the tonguing sensor 23, breath sensor 23*a* and lip sensor 24 serve as "plural sorts of sensors". At least the controller 16 and electronic tone generator 4*a* form in combination a "signal processing unit". In the preferred embodiment, the signal processing unit forms a part of the electronic system. However, the signal processing unit may form another musical instrument as described hereinbefore. The lip, tongue, lungs, thumbs and fingers are "organs" of the player. In case where the electronic system is installed in an acoustic trombone, a sensor monitors an arm instead of the thumbs and fingers.

The rotary air-flow regulator serves as a "pressure controller", and said rotary air-flow regulator 26 formed with an orifice 26*d* is corresponding to an "obstacle" and a "variable orifice plate".

What is claimed is:

1. A wind instrument for selectively producing acoustic tones and electric tones, comprising:

an acoustic wind instrument including a tubular body defining a column of air inside thereof, a mouthpiece connected to one end of said tubular body and giving rise to vibrations of said column of air for producing said acoustic tones when a player blows thereinto, and a pitch changing mechanism provided for said tubular body and manipulated with fingers of said player so as to change the length of said column of air; and an electronic system including a quasi mouthpiece connectable to said one end of said tubular body instead of said mouthpiece and permitting said player to blow thereinto without provocation of said vibrations, and plural sorts of sensors for producing detecting signals representative of actions of organs of said player and supplying said detecting signals to a signal processing unit so as to permit said signal processing unit to produce an audio signal for producing said electric tones.

2. The wind instrument as set forth in claim 1, in which selected ones of said plural sorts of sensors are provided in said quasi mouthpiece so as to monitor the actions of lips, the action of a tongue and breaths of said player.

3. The wind instrument as set forth in claim 2, in which said selected ones of said plural sorts of sensors detect a pressure of said lips exerted on said quasi mouthpiece, a distance between said quasi mouthpiece and said tongue and a pressure of said breaths.

4. The wind instrument as set forth in claim 2, in which a reflection type photo coupler is used as the sensor for detecting said distance between said quasi mouthpiece and said tongue.

5. The wind instrument as set forth in claim 1, in which selected ones of said plural sorts of sensors are provided in said quasi mouthpiece so as to monitor the actions of lips, the action of a tongue and breaths of said player, and others of said plural sorts of sensors are provided on said tubular body for monitoring actions of thumbs and fingers of said player.

6. The wind instrument as set forth in claim 5, in which said selected ones of said plural sorts of sensors detect a pressure of said lips exerted on said quasi mouthpiece, a distance between said quasi mouthpiece and said tongue and a pressure of said breaths, and said others of said plural sorts of sensors detect key actions of said pitch changing mechanism for determining the pitch of said electric tones.

7. The wind instrument as set forth in claim 6, in which combinations of pieces of magnet and Hall-effect sensors are used as said other sensors for detecting said key actions.

8. The wind instrument as set forth in claim 1, in which said quasi mouthpiece includes a body formed with a wind way into which said player blows, and a pressure controller forming a part of said wind way and manipulated by said player for varying a resistance against said breaths.

9. The wind instrument as set forth in claim 8, in which an obstacle for varying the cross section of said wind way serves as said pressure controller.

10. The wind instrument as set forth in claim 9, a variable orifice plate serves as said obstacle.

11. The wind instrument as set forth in claim 1, in which said electronic system further comprises said signal processing unit connected to said plural sorts of sensors and analyzing said actions of said organs for producing music data codes representative of said electric tones to be produced.

12. The wind instrument as set forth in claim 11, in which said electronic system further comprises a sound system connected to said signal processing unit for producing said electric tones on the basis of said music data codes.

13. An electronic system combinable with an acoustic wind instrument having a tubular body, a mouthpiece and a pitch changing mechanism, comprising:

a quasi mouthpiece connectable to one end of said tubular body instead of said mouthpiece and permitting a player to blow thereinto without provocation of vibrations of a column of air in said tubular body, and plural sorts of sensors for producing detecting signals representative of actions of organs of said player and supplying said detecting signals to a signal processing unit so as to permit said signal processing unit to produce an audio signal for producing said electric tones.

14. The electronic system as set forth in claim 13, in which selected ones of said plural sorts of sensors detect a pressure of said lips exerted on said quasi mouthpiece, a distance between said quasi mouthpiece and said tongue and a pressure of said breaths.

15. The electronic system as set forth in claim 14, in which others of said plural sorts of sensors are provided on said tubular body for monitoring actions of thumbs and fingers of said player for determining the pitch of said electric tones.

16. The electronic system as set forth in claim 13, in which said quasi mouthpiece includes a body formed with a wind way into which said player blows, and a pressure controller forming a part of said wind way and manipulated by said player for varying a resistance against said breaths.

17. The electronic system as set forth in claim 16, in which an obstacle for varying the cross section of said wind way serves as said pressure controller.

18. The electronic system as set forth in claim 17, a variable orifice plate serves as said obstacle.

19. The electronic system as set forth in claim 13, further comprising said signal processing unit connected to said plural sorts of sensors and analyzing said actions of said organs for producing music data codes representative of said electric tones to be produced.

20. The electronic system as set forth in claim 19, further comprising a sound system connected to said signal processing unit for producing said electric tones on the basis of said music data codes.

* * * * *